US005706926A

United States Patent [19]

Secher

[11] Patent Number: 5,706,926

[45] Date of Patent: Jan. 13, 1998

[54] COMBINATION TELEPHONE COVERS AND DISPENSER FOR COVERS

[76] Inventor: Gerhard A. Secher, 2070 62nd Ave. South, St. Petersburg, Fla. 33712

[21] Appl. No.: 606,850

[22] Filed: Feb. 26, 1996

[51] Int. Cl.[6] ..... H04R 1/12

[52] U.S. Cl. ..... 194/247; 379/452

[58] Field of Search ..... 194/247, 255, 194/292; 221/222, 231, 266, 277, 281; 379/451, 452

[56] References Cited

U.S. PATENT DOCUMENTS

| | | | |
|---|---|---|---|
| 1,186,031 | 6/1916 | Patterson et al. | 221/281 X |
| 1,767,634 | 6/1930 | Weiss | 221/222 X |
| 3,169,171 | 2/1965 | Wachs et al. | 379/451 X |
| 5,388,724 | 2/1995 | Adams et al. | 221/231 X |
| 5,501,329 | 3/1996 | Provence | 379/451 X |

FOREIGN PATENT DOCUMENTS

| | | | |
|---|---|---|---|
| 330805 | 9/1989 | European Pat. Off. | 379/451 |
| 2634337 | 1/1990 | France | 379/451 |
| 93/22888 | 11/1993 | WIPO | 379/451 |

*Primary Examiner*—F. J. Bartuska
*Attorney, Agent, or Firm*—Dorothy Morse; American Innovations, Inc.

[57] ABSTRACT

A protective cover that a user may place over the earpiece or the mouthpiece of a telephone receiver to protect the user from unknown and potentially harmful substances which may have been left on the receiver by a previous user. The present invention also contemplates a method for providing such covers for use with public telephones and a coin-operated dispenser which is intended for placement adjacent to public telephones so that people using public telephones may have ready access to a means for sanitary use of the earpieces and mouthpieces of public telephone receivers.

5 Claims, 4 Drawing Sheets

Figure 1
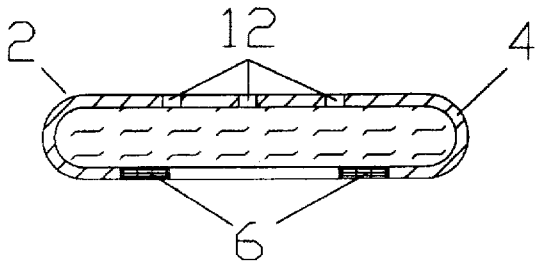
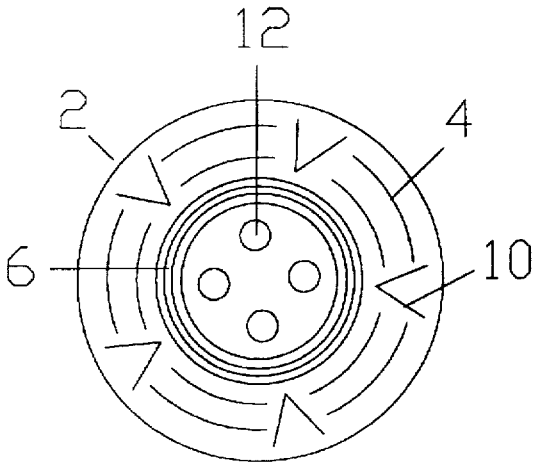
Figure 2
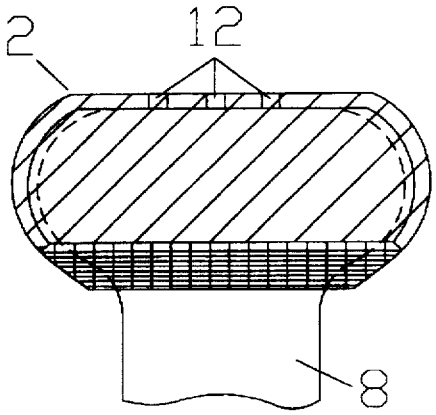
Figure 4
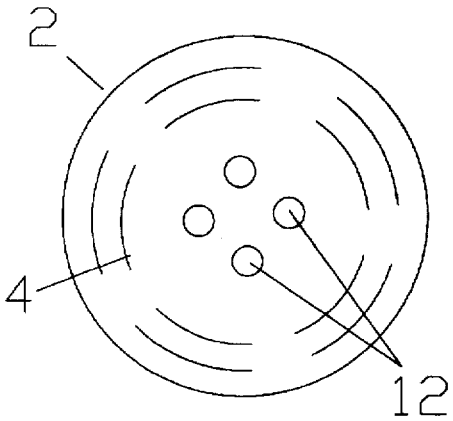
Figure 3
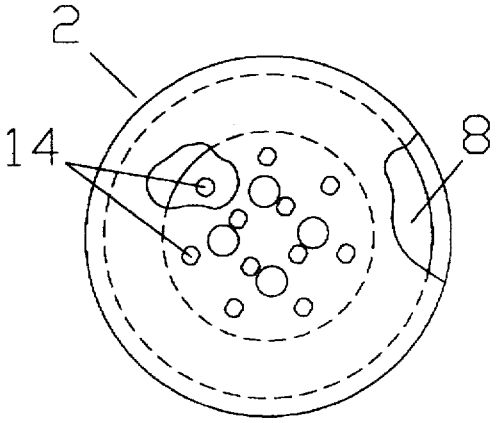
Figure 5

Figure 6
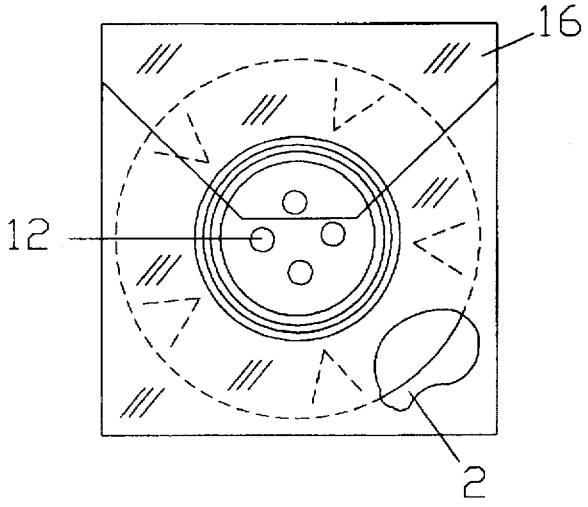
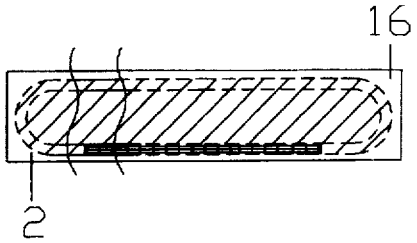
Figure 7
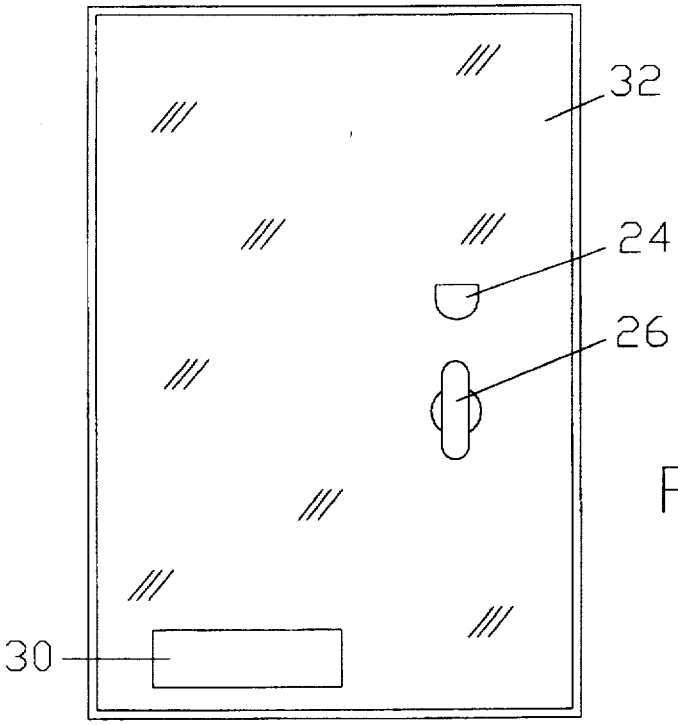
Figure 8

COMBINATION TELEPHONE COVERS AND DISPENSER FOR COVERS

BACKGROUND—FIELD OF INVENTION

This invention relates to protective covers and coin-operated dispensing machines for such covers, specifically to a protective cover that a user may place over the earpiece or the mouthpiece of a telephone receiver to protect the user from unknown and potentially harmful substances which may have been left on the receiver by a previous user and a coin-operated dispenser for such covers which is intended for placement adjacent to public telephones so that people may have ready access to a means for sanitary use of the telephone receivers.

BACKGROUND—DESCRIPTION OF PRIOR ART

Particularly during the fall and winter months when people are forced to spend more time indoors, they are likely to become exposed to cold and flu germs through contact with others. These potentially harmful substances may be transferred to a person via airborne means, such as when an infected person coughs or sneezes. In hospitals, masks and protective clothing are used to minimize exposure to such airborne substances. Potentially harmful substances may also be transferred through surface contact from one person to another, such as when two people shake hands. Exposure to potentially harmful substances may also occur when a person comes in contact with an object that has been touched by a contagious person. Grocery cart handles, door knobs, and telephone receivers are common objects which people routinely touch and which may act to transfer cold and flu germs from one person to another.

Public telephone receivers raise particular sanitary concerns since a person's ear and hair are usually placed directly against the earpiece of the receiver during use. Also during use, the person's mouth, or the part of the face adjacent to the mouth, is placed close in proximity to the mouthpiece of the receiver. Many times the person's face will come in actual contact with the mouthpiece. In an effort to sanitize a telephone receiver prior to use, a person could carry with them a bottle of alcohol and a cloth or other means for wiping a mouthpiece and earpiece with the alcohol prior to use. However, the bottle of alcohol would be bulky and inconvenient for a person to carry and it would be subject to spills. In the alternative, a person could hold the telephone receiver at a distance from his or her mouth and ear during use. However, in extended conversations this could become difficult and tiring to do. Also, when the telephone receiver is held away from the mouth and ear, the quality of the communication received by the user may be diminished, especially when the public telephone is being used in noisy locations, such as areas adjacent to heavy vehicular or pedestrian traffic. Another alternative would be for the telephone companies to install public speaker phones so that a user could carry on a conversation without the risk of placing a receiver close to the user's mouth and ear. The disadvantage of public speaker phones is that they are not practical as they compromise the privacy of phone conversations. Therefore, a person usually has little alternative but to hold an unsanitary telephone receiver adjacent to his or her mouth and ear for effective use of a public telephone.

It is not common for most people to use protection against the possible transfer of cold and flu germs from a public telephone. Cloth handkerchiefs, at one time carried by many people, may have been used to cover the mouthpiece of a telephone receiver for the protection of the user from cold and flu germs. However, most people have stopped carrying handkerchiefs in favor of disposable paper tissues which are absorbent and tear easily and thereby would not be suitable as telephone receiver covers. Also, a handkerchief has the disadvantages of muffling sounds entering a telephone receiver, being absorbent and therefore not providing a protective barrier against cold and flu germs, and not being disposable. Disposable paper disks have been proposed to cover the surface of telephone receiver mouthpieces for the protection of a user. It was contemplated for the paper disks to be distributed in multi-cover packs which a person would carry in a pocket or a purse. However, such paper disks never have been widely accepted by the public. Two reasons may explain the lack of widespread acceptance. First, it was contemplated for the paper disks to lay across the surface of the telephone mouthpiece and a person had to hold the paper disk in place during use. People may have found this inconvenient to do. Also, the flat paper disks were not easily usable with the more vertically positioned telephone earpiece. Further, it was contemplated that the flat paper disks would be carried by the user which some people may have found inconvenient to do. Should easily installed plastic or cloth covers be distributed through coin-operated dispensers placed close to a public telephone, people would be provided with a readily accessible means for sanitary means of using public telephone receivers. People with weakened immune systems, or those who are particularly susceptible to cold and flu germs, would benefit from using some sort of protection when accessing public telephones. It is not known to have a coin-operated dispenser for telephone receiver covers that will protect a user from potentially harmful substances that the user would otherwise come in contact with by use of a telephone receiver mouthpiece and a telephone receiver earpiece.

SUMMARY OF INVENTION—OBJECTS AND ADVANTAGES

It is the primary object of this invention to provide a telephone cover that will protect a user from potentially harmful substances that the user would otherwise come in contact with by use of a telephone receiver mouthpiece and a telephone receiver earpiece. It is also an object of this invention to provide a telephone cover that will fit over either the telephone receiver earpiece or the telephone receiver mouthpiece. A further object of this invention is to provide a telephone cover which is disposable after use. It is also an object of this invention to provide a coin-operated dispenser for telephone covers so that telephone covers will be readily available for use adjacent to public telephones. A further object of this invention is to provide a telephone cover that is light in weight, but tear-resistant so that it will adequately protect the user during use. It is also an object of this invention to provide a telephone cover having several small holes therethrough for enhancing communication through the telephone cover.

As described herein, properly manufactured and installed over the earpiece and the mouthpiece of a telephone receiver, the present invention would provide a disposable cover which would interchangeably fit over both the earpiece and the mouthpiece of the telephone receiver. Elastic around the outer edge of the material would gather it so that it would fit tightly around either the mouthpiece or the earpiece of the telephone receiver so as to remain in position thereon during use. Thus, the present invention would not need to be held in position during use and since it would be made of tear-resistant plastic or cloth it would offer adequate protection to a user of a public telephone from potentially harmful substances. Small holes through the surface of each disposable cover would allow a user to optimize the transfer of sound through the cover. Coin-operated dispensers located adjacent to public telephones would provide a service to users of the public telephones by offering them readily accessible protection from cold and flu germs left on telephone receivers by previous users.

The description herein provides preferred embodiments of the present invention but should not be construed as limiting the scope of the telephone cover and dispenser invention. Variations in the type of elastic used to gather the cover material, the size of the cover, the type of material used for the body of the cover, the thickness of the material used for the body of the cover, the number of holes through the material, the size of the holes, the capacity of the dispenser, and the number of covers placed within one package for use with the dispenser, other than those shown and described herein, can be incorporated into the present invention. Thus the scope of the present invention should be determined by the appended claims and their legal equivalents, rather than the examples given.

BRIEF DESCRIPTION OF THE DRAWINGS

FIG. 1 is a sectional side view of the cover portion of the invention.

FIG. 2 is a bottom view of the cover portion of the invention.

FIG. 3 is a top view of the cover portion of the invention.

FIG. 4 is a side view of the cover portion of the invention positioned over the earpiece or the mouthpiece of a telephone receiver.

FIG. 5 is a top view of the cover portion of the invention positioned over the earpiece or the mouthpiece of a telephone receiver.

FIG. 6 is a bottom view of the cover portion of the invention packaged for distribution from the dispenser portion of the invention.

FIG. 7 is a side view of the cover portion of the invention packaged for distribution from the dispenser portion of the invention.

FIG. 8 is a front view of the dispenser portion of the invention.

DETAILED DESCRIPTION OF PREFERRED EMBODIMENTS

Figure 9:
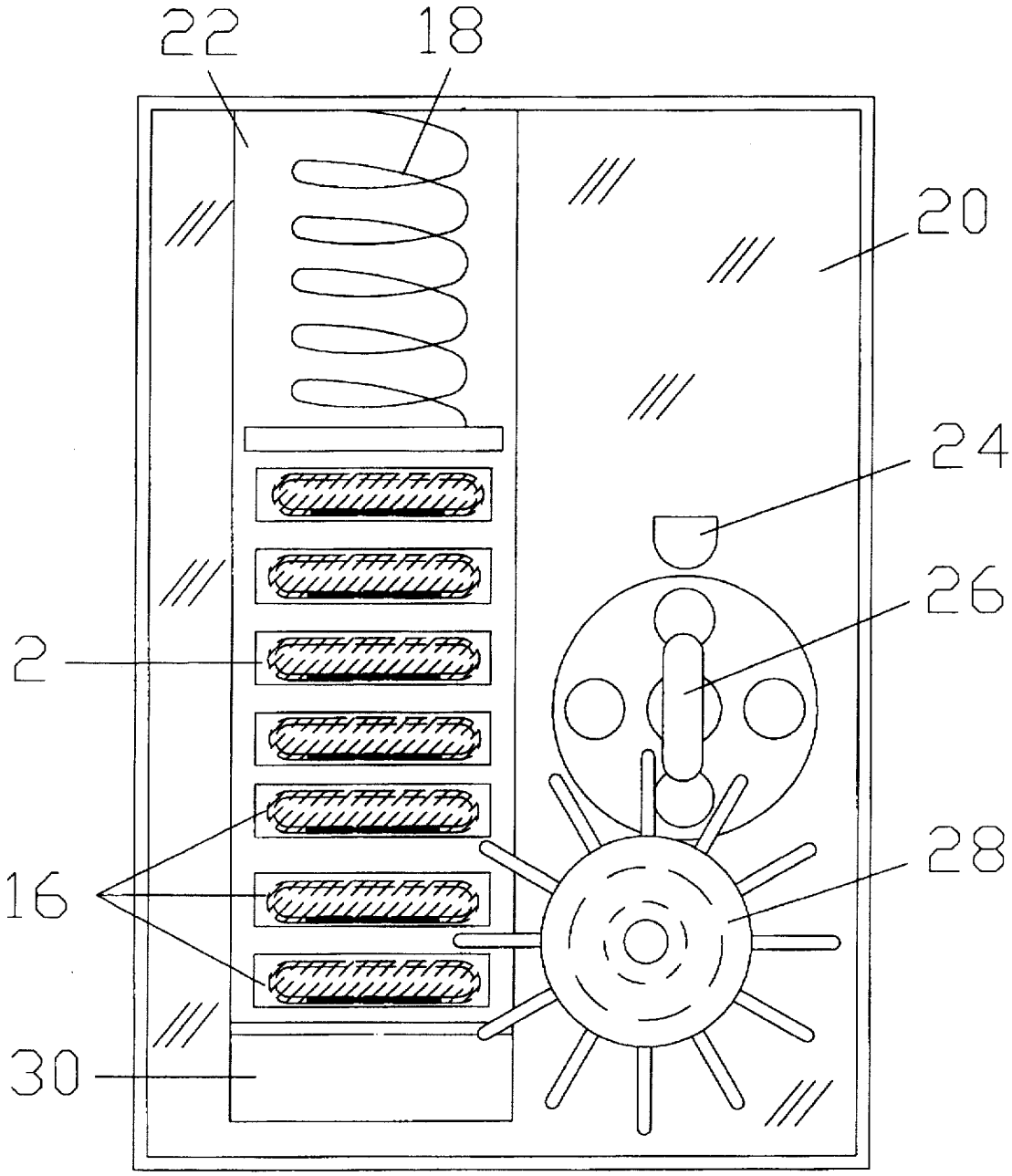
FIG. 9 is a cut-away view of the dispenser portion of the invention.

FIG. 1 shows a preferred embodiment of a telephone receiver cover 2 having a quantity of material 4, cover holes 12 centrally located through material 4, and an elastic strip 6 attached to the outer edges of material 4. Although the shape of material 4 is not critical to telephone receiver cover 2, in the preferred embodiment it is contemplated for material 4 to be approximately circular in shape, translucent, and with elastic strip 6 attached around its circumference. Also, the composition of material 4 is not critical to telephone receiver cover 2 as long as material 4 is strong enough to be tear-resistant and is not moisture absorbent. In the preferred embodiment, it is contemplated for telephone receiver cover 2 to be made of a low absorbency cloth or a plastic material. FIG. 2 shows expansion ridges 10 on the bottom portion of material 4 adjacent to elastic strip 6 and cover holes 12 extending through the top portion of material 4. FIG. 3 also shows cover holes 12 extending through the central top portion of material 4 which allow sound to pass directly through material 4 and provide for more effective communication during use of telephone receiver cover 2. In the preferred embodiment cover holes 12 are small enough so that telephone receiver cover 2 maintains its protective capability against cold and flu germs, but are large enough so that the effectiveness of communication through material 4 is not diminished.

FIG. 4 shows telephone receiver cover 2 having cover holes 12 and positioned over a portion of a telephone receiver 8. FIG. 5 shows telephone receiver cover 2 attached to a telephone receiver 8 so that telephone receiver cover 2 is placed over telephone receiver apertures 14. FIG. 6 shows telephone receiver cover 2 having cover holes 12 and placed in a disposable package 16 for sanitary distribution through the coin-operated dispenser portion of the present invention shown in FIG. 8. FIG. 7 also shows telephone receiver cover 2 placed in a disposable package 16 for distribution through the coin operated dispenser portion of the present invention.

Figure 10:
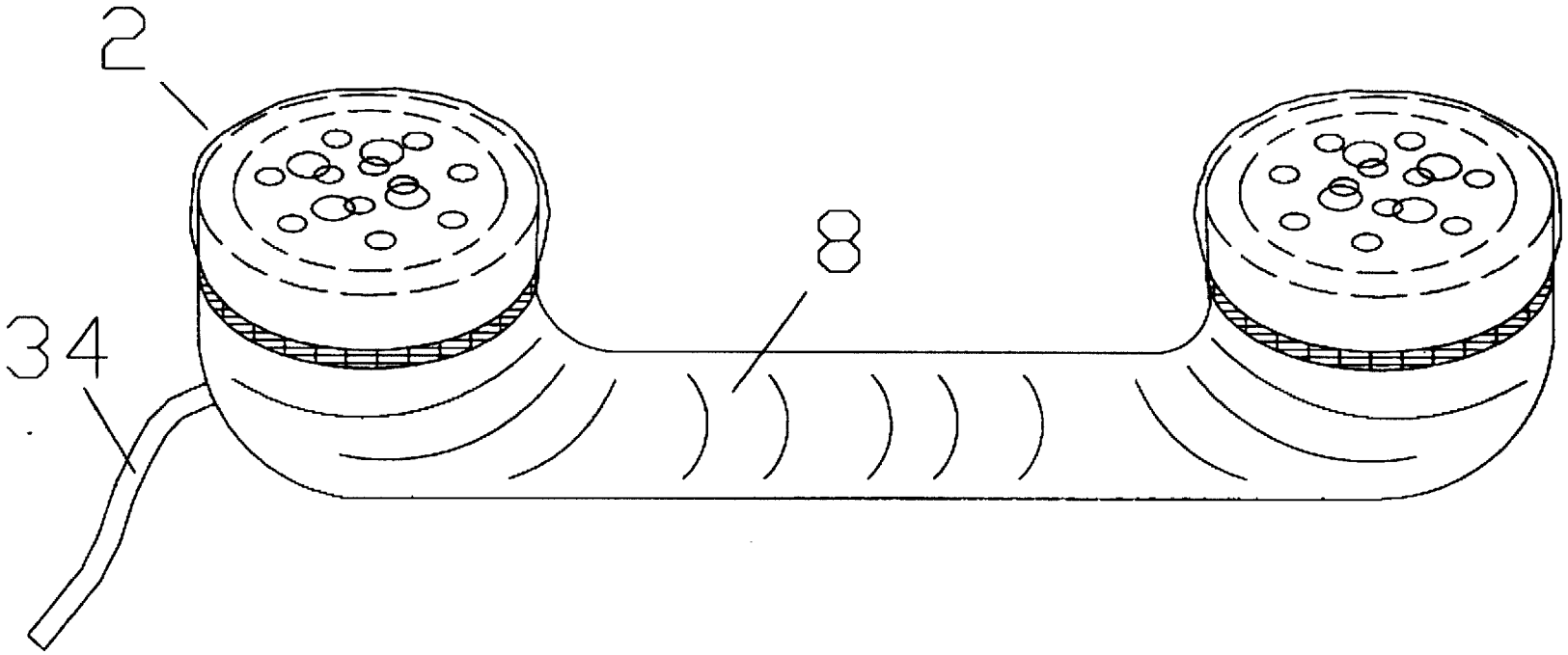
FIG. 10 is a perspective view of the invention covering both the earpiece and the mouthpiece of a telephone receiver.

FIG. 8 shows the coin-operated dispenser portion of the present invention having a housing door 32, a coin slot 24 communicating through housing door 32, a coin-turning knob 26 positioned on the outside surface of housing door 32 beneath coin slot 24, a dispensing chute 30 also communicating through housing door 32, a lock 25 attached to housing door 32, a key 27 for use in operating lock 25, and a hinge 29 for use in opening housing door 32. Although in the preferred embodiment hinge 29 is located at the bottom edge of housing door 32, so that when opened housing door 32 may be used as a working tray, it is contemplated for hinge 29 to be positioned on any of the edges of housing door 32. FIG. 9 shows the coin-operated dispenser portion of the present invention having a housing 20 within which coin-turning knob 26 cooperates with coin slot 24 and a dispensing wheel 28. A storage chute 22, also positioned within housing 20 adjacent to dispensing wheel 28, communicates with dispensing chute 30. When packages 16 containing telephone receiver covers 2 are placed into storage chute 22, a spring 18 attached to housing 20 biases packages 16 toward dispensing chute 30, so that when a coin (not shown) is placed into coin slot 24 and coin-turning knob 26 is rotated, such rotation causes dispensing wheel 28 to turn and cause one package 16 to be transferred into dispensing chute 30. The location of coin slot 24, coin-turning knob 26, dispensing wheel 28, storage chute 22, and dispensing chute 30 within housing 20, as shown in FIG. 9, is not critical to the present invention. For example, coin slot 24, coin-turning knob 26, and dispensing wheel 28 could be located on the left side of storage chute 22 instead of its right side. It is contemplated for the present invention to have any positioning within housing 20 for coin slot 24, coin-turning knob 26, dispensing wheel 28, storage chute 22, and dispensing chute 30 which allows coin slot 24, coin-turning knob 26, dispensing wheel 28, storage chute 22, and dispensing chute 30 to interact successfully for the dispensing of packages 16 containing telephone receiver covers 2 into dispensing chute 30. FIG. 10 shows a telephone cord 34 and two telephone receiver covers 2 attached to telephone receiver 8.

What is claimed is:

1. A method for providing telephone receiver covers adjacent to public telephones having receiver mouthpieces and earpieces to offer users of said public telephones protection from potentially harmful substances which may be have been placed onto said mouthpieces and said earpieces by prior users, said method comprising the steps of providing a plurality of coins of the proper denomination to dispense as many of said telephone receiver covers as needed, a plurality of packages containing telephone receiver covers, each of said telephone receiver covers having a quantity of flexible material having a size adequate to surround the larger of any of said public telephone mouthpieces and any of said earpieces, said material also having a central portion and a plurality of holes through said central portion for allowing telephone communication through said material, said telephone receiver cover also comprising gathering means for securing said material to each of said mouthpieces and each of said earpieces during use, and also providing a plurality of telephone cover dispensers, each of said telephone cover dispensers having a housing containing at least one storage chute communicating with at least one dispensing chute, at least one coin slot, at least one coin-turning knob, and at least one dispensing wheel; placing each of said telephone cover dispenser housings adjacent to one of said public telephones; placing a quantity of said packages containing said telephone receiver covers into at least one of said storage chutes; determining a required number and type of coins for said user to place into each of said coin slots to cause each of said dispensing wheels to deposit at least one of said packages into one of said dispensing chutes; fixing each of said telephone cover dispensers to receive said required number and type of coins for said user to place into each of said coin slots to cause each of said dispensing wheels to deposit at least one of said packages into one of said dispensing chutes; placing said required number of coins into said coin slot; rotating said coin-turning knob to cause said dispensing wheel to turn and deposit at least one of said packages into one of said dispensing chutes; and repeating the steps of placing said required number of coins into said coin slot and rotating said coin-turning knob until said needed number of said packages have been dispensed.

2. A protection system for use with a telephone receiver having a mouthpiece and an earpiece, the protection system comprising:

a protective cover formed of a quantity of flexible material which is sized so as to be able to surround either one of the mouthpiece and the earpiece, said material including a central portion with a plurality of holes therethrough for facilitating sound transmission through the material and an outer edge having a quantity of elastic attached thereto for securing said material to either one of said mouthpiece and said earpiece during use of said protective cover, said outer edge being spaced from said central portion so as to form a hollow space into which one of the mouthpiece and earpiece is disposed during use, said cover being circular in shape and further including a plurality of expansion ridges formed on the material between the central portion and the outer edge and spaced from each other circumferentially about the material; and a protective package enclosing the protective cover, said protective package being rectangular in shape and having a thickness sufficient to accommodate the spacing between the outer edge and the central portion.

3. The protection system according to claim 2, wherein said material comprises a lightweight, tear-resistant plastic.

4. The protection system according to claim 2, wherein said material comprises lightweight, low absorbency cloth.

5. The protection system according to claim 2, wherein said quantity of elastic comprises an elastic strip.

* * * * *